US007410167B2

(12) United States Patent
Koga et al.

(10) Patent No.: US 7,410,167 B2
(45) Date of Patent: Aug. 12, 2008

(54) RECORDING MEDIUM FEEDING METHOD AND IMAGE RECORDING APPARATUS

(75) Inventors: Yuji Koga, Aichi-ken (JP); Masatoshi Izuchi, Aichi-ken (JP); Tetsuya Ouchi, Aichi-ken (JP); Shohei Koide, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 381 days.

(21) Appl. No.: 11/275,191

(22) Filed: Dec. 16, 2005

(65) Prior Publication Data

US 2007/0003352 A1 Jan. 4, 2007

(30) Foreign Application Priority Data

Dec. 17, 2004 (JP) ..... 2004-366930

(51) Int. Cl.
*B65H 5/12* (2006.01)

(52) U.S. Cl. ..... 271/266; 271/265.01; 271/270; 400/578; 400/579; 400/636; 400/637; 400/637.1; 400/645; 400/706

(58) Field of Classification Search ..... 271/270, 271/265.01, 266; 400/578, 579, 636, 637, 400/637.1, 645, 706
See application file for complete search history.

(56) References Cited

U.S. PATENT DOCUMENTS 5,602,571 A 2/1997 Suda et al.
5,965,862 A * 10/1999 Momose ..... 235/449
6,095,703 A 8/2000 Tanaka et al.
6,550,907 B2 * 4/2003 Uchida ..... 347/104
6,554,275 B1 * 4/2003 Tranquilla ..... 271/259
6,641,134 B1 * 11/2003 Dobbertin et al. ..... 271/226
6,644,656 B2 * 11/2003 Muranaka ..... 271/225
6,733,009 B2 * 5/2004 Ogasawara ..... 271/265.01

FOREIGN PATENT DOCUMENTS

JP 4191074 7/1992
JP 9240088 9/1997
JP 2002361958 12/2002

* cited by examiner

*Primary Examiner*—Patrick Mackey
*Assistant Examiner*—Prasad V Gokhale
(74) *Attorney, Agent, or Firm*—Baker Botts L.L.P.

(57) ABSTRACT

A method for feeding a recording medium includes the steps of: feeding the recording medium along a sheet-feeding path by a unit feeding amount, detecting an entrance of a rear end of the recording medium into a jumping alarm area, dividing the unit feeding amount into minute divisional feeding amounts such that the recording medium is fed by each minute divisional feeding amount when the rear end of the recording medium enters the jumping alarm area, detecting a jumping amount of the recording medium corresponding to a rotation of a driving roller when a jumping phenomenon occurs in the recording medium, and adjusting the minute divisional feeding amount to cancel the jumping amount.

15 Claims, 12 Drawing Sheets

FIG. 8A

COMPENSATION AMOUNT TABLE T

| COMPENSATION POSITION n | 0 | 1 | 2 | 3 | 4 | ··· |
|---|---|---|---|---|---|---|
| COMPENSATION AMOUNT a | 6 | 6 | 6 | 0 | 0 | ··· |

FIG. 8B

COMPENSATION AMOUNT TABLE T

| COMPENSATION POSITION n | 0 | 1 | 2 | 3 | 4 | ··· |
|---|---|---|---|---|---|---|
| COMPENSATION AMOUNT a | 6 | 0 | 6 | 0 | 6 | ··· |

FIG. 10

| COMPENSATION POSITION n | 1 | 2 | 3 | 4 | 5 | 6 | 7 | 8 | 9 | 10 | 11 | 12 |
|---|---|---|---|---|---|---|---|---|---|---|---|---|
| MINUTE DIVISIONAL FEEDING AMOUNT L' | 6 | 6 | 6 | 6 | 6 | 1 | 2 | 6 | 6 | 6 | 6 | 3 |
| JUMPING AMOUNT J | 0 | 0 | 0 | 0 | 9 | 0 | 0 | 0 | 0 | 0 | 0 | 0 |
| COMPENSATION AMOUNT a | 0 | 0 | 0 | 0 | 0 | 5 | 4 | 0 | 0 | 0 | 0 | 0 |

RECORDING MEDIUM FEEDING METHOD AND IMAGE RECORDING APPARATUS

CROSS REFERENCE TO RELATED APPLICATION

This application claims priority from Japanese Patent Application No. 2004-366930, filed on Dec. 17, 2004, the entire subject matter of which is incorporated herein by reference.

TECHNICAL FIELD

Aspects of the present invention relate to an image recording apparatus for recording an image on a recording medium, nipped and fed by rollers disposed on a sheet feeding path, using a recording device, and more particularly, to a recording medium feeding method applied to the image recording apparatus.

BACKGROUND

FIG. 11 is a view illustrating a peripheral structure of an image recording part of a conventional image recording apparatus. As shown in the drawing, a recording head 91 is installed in the upper side of a sheet-feeding path 90 and is configured to scan in the width direction of a recording sheet P and to eject ink onto the recording sheet P. A platen 92 for supporting the recording sheet during the recording is disposed in the lower side of the sheet-feeding path 90 opposite to the recording head 91. The conventional image-recording device is constituted in this manner. Moreover, at the upstream and the downstream in the sheet-feeding direction of the recording head 91, driving rollers 93 and 94 and pressing rollers 95 and 96 are respectively provided at the opposite sides of the sheet-feeding path 90 to constitute a sheet-feeding device. Although not depicted in the drawing, the driving rollers 93 and 94 are designed such that a driving force is transmitted from a driving power source such as a motor or the like via a gear or the like. The pressing rollers 95 and 96 are movable up and down and respectively urged toward the driving roller 93 and 94 by springs or the like to be brought into close contact with the driving rollers 93 and 94.

The recording sheet P, fed from a sheet tray (not shown) by the sheet-feeding device, is nipped by the driving roller 93 and the pressing roller 95, disposed at the upstream, and is fed to the upper side of the platen 92. When the leading end of the recording sheet P has arrived to the lower side of the recording head 91 and the recording head 91 starts to scan, the recording head 91 ejects ink onto the recording sheet P. The driving roller 93 and the pressing roller 95 are intermittently driven at a predetermined linefeed width. The recording head 91 scans whenever the driving roller 93 and the pressing roller 95 are intermittently driven, and these operations are repeated such that an image is recorded in a desired area in the recording sheet P fed at every predetermined linefeed width. Moreover, when the leading end of the recording sheet P has arrived at the driving roller 94 and the pressing roller 96 at the downstream, the image recording is performed in the state that the leading end of the recording sheet P is nipped by the driving roller 94 and the pressing roller 96 and the rear end of the recording sheet P is nipped by the driving roller 93 and the pressing roller 95. Additionally, when the recording sheet P is further fed, the rear end of the recording sheet P passes through the driving roller 93 and the pressing roller 95, and the recording sheet P is fed by the driving roller 94 and the pressing roller 96 at the downstream. Furthermore, after the recording of the image, the recording sheet P passes through the driving roller 94 and the pressing 96 and is discharged to a sheet discharge tray (not shown).

Here, when the driving roller 93 and the pressing roller 95, which are installed at the upstream of the recording head 91, form a nip area where the roller surfaces of the rollers are close contact with each other. When the rear end of the recording sheet P passes through the nip area, the urging force of the pressing roller 95 is applied to the rear end of the recording sheet P as the nipping force by the driving roller 93 and the pressing roller 95 is suddenly released, so that the recording sheet P is pushed out in the sheet-feeding direction. Due to the pushing force, there is generated a so-called jump that the recording sheet P is fed more than the predetermined linefeed width. When the jump is generated, the recording position in the sub-scanning direction is shifted. For example, due to the jump, there are generated specks or white spots in the recorded image when printing the image on the whole area of the recording sheet, such as the case of printing photographs.

In order to solve the above-described problem, there is known a method for controlling the driving roller 93 to feed the recording sheet S by an amount that is smaller than the predetermined linefeed width by an estimated jumping amount that is likely to be generated when the rear end of the recording sheet P passes through the nip area between the driving roller 93 and the pressing roller 95 (See JP-A-9-240088). In other words, when the rear end of the recording sheet P passes through the nip area between the driving roller 93 and the pressing roller 95, the rotation of the driving roller 93 is controlled to feed the recording sheet P by an amount that the jumping amount is subtracted from the predetermined linefeed width. By doing so, even if the recording sheet P jumps, the linefeed width is not increased and the white spots can also prevent from being formed.

Moreover, there is known a method for obtaining a feeding error by detecting the jumping amount of the recording sheet P using the revolution of the driving roller 94 disposed at the downstream of the driving roller 93 and the pressing roller 95 and for compensating the feeding error (See JP-A-2002-361958) In other words, when the recording sheet P jumps, the driving roller 94 nipping and feeding the recording sheet rotates more than the predetermined linefeed width. Thus, the feeding error can be obtained from the revolution of the driving roller 94. When the feeding error is detected, instead of performing the above-described usual image recording by the recording head 91, the recording sheet is fed in the reverse direction and the recording head 91 then performs scanning. Also, instead of the reverse feeding of the recording sheet P, the number more than the usual number of nozzles of the recording head 91 may be disposed in the feeding direction. While shifting the using nozzles so as to correspond to the feeding error, the image can be recorded on the recording sheet. By doing so, the specks and the white spots can be prevented from being formed even if the recording sheet P jumps.

SUMMARY

However, the jumping amount, generated when the rear end of the recording sheet P passes through the nip area between the driving roller 93 and the pressing roller 95, is changed by the size and the thickness of the recording sheet P, and is not always uniform. FIG. 12 is a plan view illustrating the arrangement of the driving roller 93 and the pressing roller 95. As shown in the drawing, four pressing rollers 95 are arranged with respect to a single driving roller 93 at predetermined intervals in the axis direction and are urged against the driving roller 93 by an urging device such as a spring (not shown) such that the roller surfaces of the respective pressing rollers 95 come into close contact with the roller surface of the driving roller 93 to form the nip area N. Thus, for example, when the width of the recording sheet P extends nearly the whole width of the driving roller 93, the recording sheet P is nipped by the four pressing rollers 95. However, when the width of the recording sheet P extends about a half of the width of the driving roller 93, the recording sheet P is nipped by two pressing rollers 95. If the number of the pressing rollers 95 for nipping the recording sheet P is different, the pushing force of pressing rollers 95 for pushing the recording sheet P due to the urging force is also different. Thus, the jumping amount generated in the recording sheet P is also different. Similarly, when the thickness of the recording sheet P is changed, the jumping amount is changed. Furthermore, the rear end of the recording sheet P does not necessarily pass through the respective nip areas of the four pressing rollers 95 at the same time, and the jumping amount may be different due to the passing timing of the recording sheet P. As such, it is difficult to compensate for the jumping amount, which is changed due to the size, the thickness of the recording sheet P, and the passing timing of the rear end of the recording sheet P, with a uniform estimated value. Moreover, the passing timing of the rear end of the recording sheet P is difficult to be estimated in advance. The passing timing varies for each sheet P even when the recording sheets P have the same thickness and the same size.

Meanwhile, in order to detect the jumping amount of the recording sheet P using the revolution of the driving roller 94 disposed at the downstream of the recording head 91 the feed of the recording sheet P should be synchronized with the rotation of the driving roller 94. Thus, in order to bring the recording sheet P into close contact with the downstream driving roller 94, the urging force must be increased by the pressing roller 96. However, since the pressing roller 96 comes into contact with the recorded surface recorded by the recording head 91 immediately after the recording, and the nipping mark of the pressing roller 96 may remain in the recorded image when the urging force due to the pressing roller is too strong, it is not desirable to increase the urging force of the pressing roller 96. However, when the urging force of the pressing roller 96 is weak, the jumping amount of the recording sheet P cannot be precisely detected.

Moreover, in order to compensate for the detected jumping amount of the recording sheet P, the driving roller 94 must be reversely rotated such that the recording sheet P is fed in the reverse direction by the jumping amount as a feeding error. Further, components of the driving device must be controlled in consideration of backlash between gears in a power transmission mechanism. Thus, the compensation is extremely complicated.

Aspects of the present invention provide a method for detecting a jumping amount of a recording medium and simply and precisely compensating the jumping amount.

According to an aspect of the invention, there is provided a method for feeding a recoding medium for use in an image recording apparatus including a sheet-feeding path, a feeding device disposed at an upstream side of the sheet-feeding path and having a rotation sensor, a pair of rollers for nipping the recording medium and a recording device disposed at a downstream side of the sheet-feeding path to record an image on the recording medium to be fed, the method including the steps of: feeding the recording medium along the sheet-feeding path by a unit feeding amount; detecting an entrance of a rear end of the recording medium into a jumping alarm area; dividing the unit feeding amount into minute divisional feeding amounts such that the recording medium is fed by each minute divisional feeding amount when the rear end of the recording medium enters the jumping alarm area; detecting a jumping amount of the recording medium according to the rotation sensor when a jumping phenomenon occurs in the recording medium; and adjusting the minute divisional feeding amount to cancel the jumping amount.

In the above aspect of the invention, preferably, the recording medium is fed along the feeding path by a unit feeding amount by the feeding device. Here, the "unit feeding amount" means a predetermined linefeed width of the recording medium on which the image is continuously recorded by the recording device. Thus, the recording medium is fed by the corresponding linefeed width by the feeding device such that the image is recorded by the linefeed width by the recording device. After this, when the rear end of the recording medium enters the NIP area, the recording medium is not fed by the unit feeding amount, but by a minute divisional feeding amount that the unit feeding amount is divided into plurals. Here, the "jumping area" means an area where the possibility of the jumping phenomenon of the recording medium is high, specifically, that the vicinities of the pair of rollers for nipping the recoding medium at the upstream of the recording device. The rotation sensor detects the jumping phenomenon and the jumping amount and the minute divisional feeding amount is adjusted to cancel the jumping amount generated due to the jumping phenomenon when the jumping phenomenon of the recording medium occurs.

According to another aspect of the invention, there is provided a method for feeding a recoding medium for use in an image recording apparatus including a sheet-feeding path, a feeding device disposed at an upstream side of the sheet-feeding path and having a rotation sensor, a pair of rollers for nipping the recording medium, a recording device disposed at a downstream side of the sheet-feeding path to record an image on the recording medium to be fed and a size determining device for determining a size of the recording medium, the method including the steps of: feeding the recording medium along the sheet-feeding path by a unit feeding amount; detecting an entrance of a rear end of the recording medium into a jumping alarm area; dividing the unit feeding amount into minute divisional feeding amounts such that the recording medium is fed by each minute divisional feeding amount when the rear end of the recording medium enters the jumping alarm area; and adjusting the minute divisional feeding amount by a predetermined compensation amount when the recording medium is equal to or smaller than a predetermined size.

In the above aspect of the invention, when the recording medium is equal to or smaller than a predetermined size, the minute divisional feeding amount is adjusted by a predetermined adjusting amount.

According to still another aspect of the invention, there is provided an image recording apparatus for recording an image on a recording medium, including: a sheet-feeding path; a feeding device including a pair of rollers disposed at an upstream side of the sheet-feeding path to nip the recording medium and to feed the recording medium along the sheet-feeding path by a unit feeding amount; a recording device disposed at a downstream side of the sheet-feeding path to record the image on the recording medium; a position sensor that detects a position of a rear end of the recording medium being fed; a rotation sensor that detects a rotation of the roller; and a controller that controls the rotation of the roller, the controller including a first controlling part for controlling the rotation of the roller such that the unit feeding amount is divided into a plurality of minute divisional feeding amounts and the recoding medium is fed by a corresponding minute divisional feeding amount when the end of the recording medium enters a jumping alarm area, and a second controlling part for controlling the rotation of the roller such that, when a jumping phenomenon occurs in the recording medium, a jumping amount of the recording medium is estimated based on the revolution of the rotation sensor to cancel the jumping amount.

BRIEF DESCRIPTION OF THE DRAWINGS

Illustrative aspects of the invention may be more readily described with reference to the accompanying drawings:

FIGS. 8A and 8B are views showing compensation amount tables;

FIG. 10 is a view illustrating a minute divisional feeding amount, a jumping amount, and a compensation amount a after compensation when divisionally and minute divisional feeding a recording sheet larger than a 2L size;

DETAILED DESCRIPTION

Hereinafter, an illustrative aspect of the present invention will be described in detail with referent to the accompanying drawings.

Figure 1:
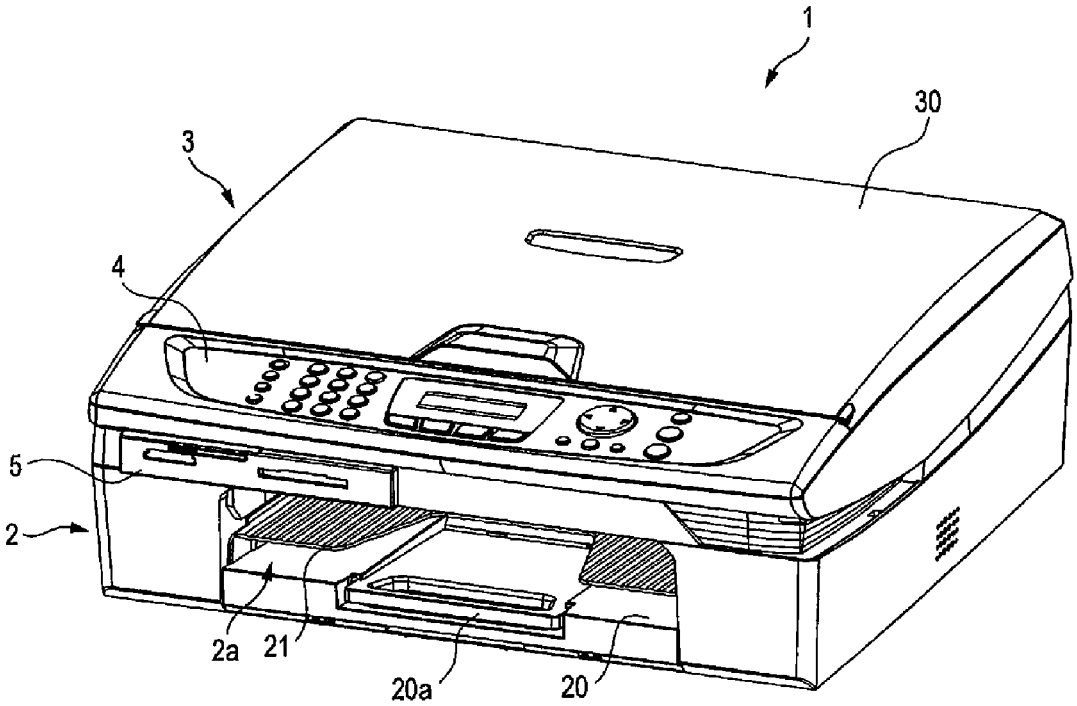
FIG. 1 is a perspective view illustrating an external appearance of a multi function device according to an illustrative aspect of the present invention.

FIG. 1 is a perspective view illustrating an external appearance of a multi function device 1 (an image recording apparatus) according to an illustrative aspect of the present invention. The image recording apparatus 1 is a multi function device including a printer 2 provided in the lower side and a scanner 3 provided in the upper side thereof, and has a printing function, a scanning function, and a copying function. The printer 2 in the multi function device 1 corresponds to the image recording apparatus, and other functions are optional. Thus, the image recording apparatus maybe a single functional printer not equipped with the scanner 3 and not having the scanning function or the copying function. Also, the image recording apparatus may be equipped with a communication part to have facsimile function. Moreover, when the image recording apparatus is implemented by a multi function device, the multi function device 1 may be a small sized multi function device such as that according to the illustrative aspect of the present invention, or a large sized multifunction device including a plurality of sheet cassettes or an automatic document feeder (ADF). The image recording apparatus 1 is mainly connected to a computer (not shown) and records documents and images on recording sheets based on image data and document data transmitted from the computer. The image recording apparatus 1 can be connected to a digital camera to record image data output from the digital camera on the recording sheets, or can be provided with a variety of recording media to record the image data recorded in the recording media on the recording sheets.

As shown in FIG. 1, the multi function device 1 has a roughly rectangular external appearance and includes the printer 2 installed in the lower side thereof. The printer 2 has an opening 2*a* formed in the front side thereof. A sheet supply tray 20 and a sheet discharge tray 21 are vertically disposed in the form of a double stairs to be exposed through the opening 2*a*. The sheet supply tray 20 accommodates a variety of recording sheets as a recoding medium such as A4 recording sheets, B5 recording sheets, postcard sized recording sheets, and if necessary, is structured such that the tray surface can be expanded by dragging out a slide tray 20*a*. The recording sheets (not shown) accommodated in the sheet supply tray 20 are fed into the printer 2 such that desired images are recorded on the recording sheets and the recording sheets on which the desired images are recorded are discharged to the sheet discharge tray 21.

Figure 2:
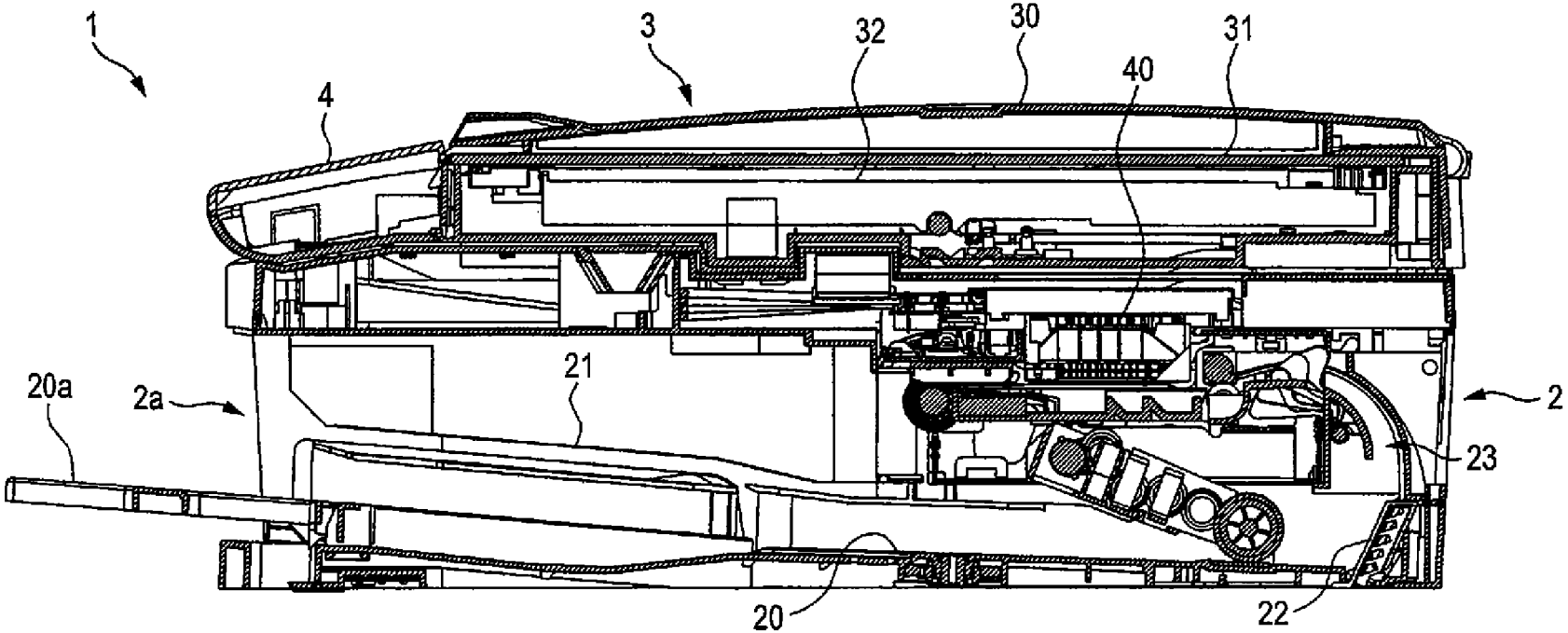
FIG. 2 is a vertical sectional view illustrating an internal structure of the multi function device.

The scanner 3 is installed in the upper side of the multi function device 1, and is a so-called flat bed scanner. As shown in FIGS. 1 and 2, a platen glass 31 and an image reading carriage 32 are disposed in the lower side of a cover 30 of the multi function device 1. The cover 30 can be opened and closed. An original copy to be image-scanned is put on the platen glass 31, and the image reading carriage 32 having a main scanning direction along a depth direction perpendicular to the sheet of FIG. 2 is installed in the lower side of the platen glass 31 to scan in the width direction of the multi function device In the front upper side of the multi function device 1, a manipulation panel 4 for manipulating the printer 2 and the scanner 3 is provided. The manipulation panel 4 includes various manipulation buttons and a liquid crystal display. The multi function device 1 is operated by the manipulation command input through the manipulation panel 4 and by the command transmitted via a printer driver from the computer connected to the multi function device. For example, in the front left upper side of the multi function device 1, a slot 5 is provided such that various small memory cards are loaded so that a user can input a command with the manipulation panel 4 to read image data recorded in the small memory card inserted into the slot 5, to display the read image data on the liquid crystal display, and to record the read image data on the recording sheet using the printer 2.

Hereinafter, the internal structure of the multi function device 1, particularly, the printer 2 will be described in detail with reference to FIGS. 2 and 3. As shown in the drawings, inside the sheet supply tray 20 provided on the bottom of the multi function device 1, an inclined separation plate 22 is disposed to separate the recording sheets accommodated in the sheet supply tray 20 and to guide the separate sheet upward. A feeding path 23 is formed from the inclined separation plate 22 to the upper side. Since the feeding path 23 extends upward and curves to the front side, and extends from the rear side to the front side of the multi function device 1, the feeding path 23 communicates with the sheet discharge tray 21 via an image recording part 24 (recording device). Thus, the recording sheets accommodated in the sheet supply tray 20 are guided as U-turning from the lower side to the upper side through the feeding path 23 and reach the image recording part 24. The image recording part 24 records the image on the guided recording sheet. The recording sheet on which the image is recorded is discharged to the sheet discharge tray 21.

Figure 3:
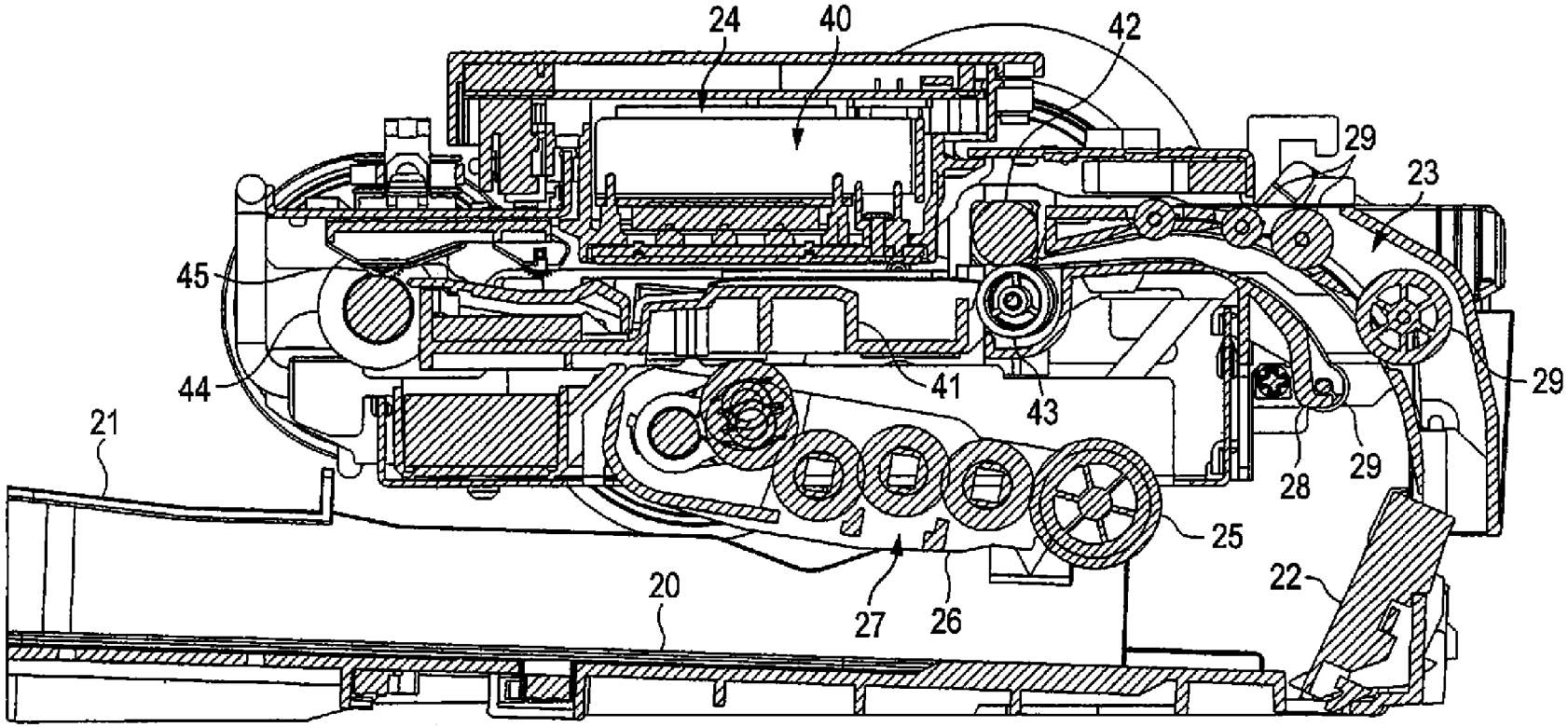
FIG. 3 is an enlarged sectional view illustrating main components of a printer part.

As shown in FIG. 3, in the upper side of the sheet supply tray 20, a sheet supply roller 25 is provided to separate the recording sheets into a single recording sheet and to supply the separate recording sheet along the feeding path 23 one by one. The sheet supply roller 25 is supported by a leading end of a sheet supply arm 26 moving up and down to be in contact with and separate from the sheet supply tray 20, and is rotated such that a driving force of a motor (not shown) is transmitted by a power transmission mechanism 27 in which plural gears are engaged with each other. The sheet supply arm 26 is installed to move up and down about the base end thereof so that the sheet supply arm 26 moves up due to a sheet supply clutch (not shown) or a spring (not shown) in a standby mode as shown in the drawing, and moves down when supplying the recording sheets. When the sheet supply arm 26 moves down, the sheet supply roller 25 supported by the leading end of the sheet supply arm 26 presses the surface of the recording sheet in the sheet supply tray 20. In this state, the sheet supply roller 25 rotates so that the uppermost recording sheet is fed to the inclined separation plate 22 due to the friction between the roller surface of the sheet supply roller 25 and the recording sheet. The separate recording sheet is guided upward by the leading end of the recording sheet being in contact with the inclined separation plate 22 and is sent to the feeding path 23. When the uppermost recording sheet is fed by the sheet supply roller 25, the recording sheet directly below the uppermost recording sheet may be fed together with the uppermost recording sheet due to the friction and/or static electricity. However, the recording sheet directly below the uppermost recording sheet collides against the inclined separation and is blocked.

The feeding path 23 has an outer guide wall and an inner guide wall, spaced apart from each other, at locations where the image recording part 24 and other components are not disposed. For example, the feeding path 23 at the rear side of the multi function device 1 is formed such that the outer guide wall thereof is integrally formed with a frame of the multi function device 1, and a guide member 28 of the inner guide wall is fixed in the frame of the multi function device 1. Moreover, in the feeding path 23, particularly where the feeding path 23 is curved, respective feeding rollers 29 are installed to expose their roller surfaces through the outer guide wall or the inner guide wall, and to rotate about the width direction of the feeding path. Due to the respective feeding rollers 29, the recording sheets that is in contact with the guide walls at the location where the feeding path 23 is curved are smoothly fed.

As shown in FIG. 3, in the downstream of part of the feeding path 23 which U-turns from the lower side to the upper side, the image recording part 24 is disposed. The image recording part 24 includes an inkjet recording head 40, installed in a scanning carriage (not shown), disposed to scan in the width direction of the feeding path 23 (a main scanning direction) such that the inkjet head 40 scans while ejecting color inks such as cyan (C), magenta (M), yellow (Y), and black (K) to record images on the fed recording sheets.

Moreover, in the upstream of the image recording part 24, a pair of driving roller 42 and pressing roller 43 is provided to nip and feed the recording sheets fed along the feeding path 23 onto a platen 41. Meanwhile, in the downstream of the image recording part 24, a pair of sheet discharge roller 44 and spur roller 45 is disposed to nip and feed the recorded recording sheets. A driving force of a motor (not shown) is transmitted to intermittently drive the driving roller 42 and the sheet discharge roller 44 by a predetermined linefeed width. Meanwhile, the pressing roller 43 is rotatably urged to press the driving roller 42 with a predetermined pressure such that, when the recording sheet enters between the pressing roller 43 and the driving roller 42, the pressing roller moves back as much as the thickness of the recording sheet so that the pressing roller 43 and the driving roller 42 nip the recording sheet and a driving force of the driving roller 42 is securely transmitted to the recording sheet. The spur roller 45 is provided relative to the sheet discharge roller 44 in the same manner. Since the spur roller 45 is brought into close contact with the recorded recording sheets, the spur roller may have a roller surface having a spur-shape to prevent the images recorded on the recording sheets from being damaged.

Therefore, the recording sheet nipped by the driving roller 42 and the pressing roller 43 is intermittently fed on the platen 41 by the predetermined linefeed width such that the inkjet recording head 40 scans every linefeed width to record an image on the recording sheet from the leading end thereof. The recording sheet on which the image is recorded is intermittently fed by the predetermined linefeed width in a state that the leading end of the recording sheet is nipped by the sheet discharge roller 44 and the spur roller 45, and the rear end of the recording sheet is nipped by the driving roller 42 and the pressing roller 43, and the inkjet recording head 40 records the image on the recording sheet. When the recording sheet is further fed, the rear end of the recording sheet passes through the driving roller 42 and the pressing roller 43. Due to the passing, the nip is released so that the sheet discharge roller 44 and the spur roller 45 intermittently feed the recording sheet by the predetermined linefeed width and the inkjet recording head 40 records the image on the recording sheet in the same manner. After the image recording is finished, the sheet discharge roller 44 continuously rotates such that the recording sheet nipped by the sheet discharge roller 44 and the spur roller 45 is discharged to the sheet discharge tray 21.

Here, the predetermined linefeed width is a unit feeding amount. When the image is recorded on the recording sheet, the driving roller 42 and the sheet discharge roller 44 are usually intermittently rotated according to the unit feeding amount. The linefeed width varies according to an image recording density or the like, for example, when images are recorded in the interlace way, the linefeed width when images are recorded in a fine mode of a high density is generally smaller than when images are recorded in a usual mode.

Figure 4:
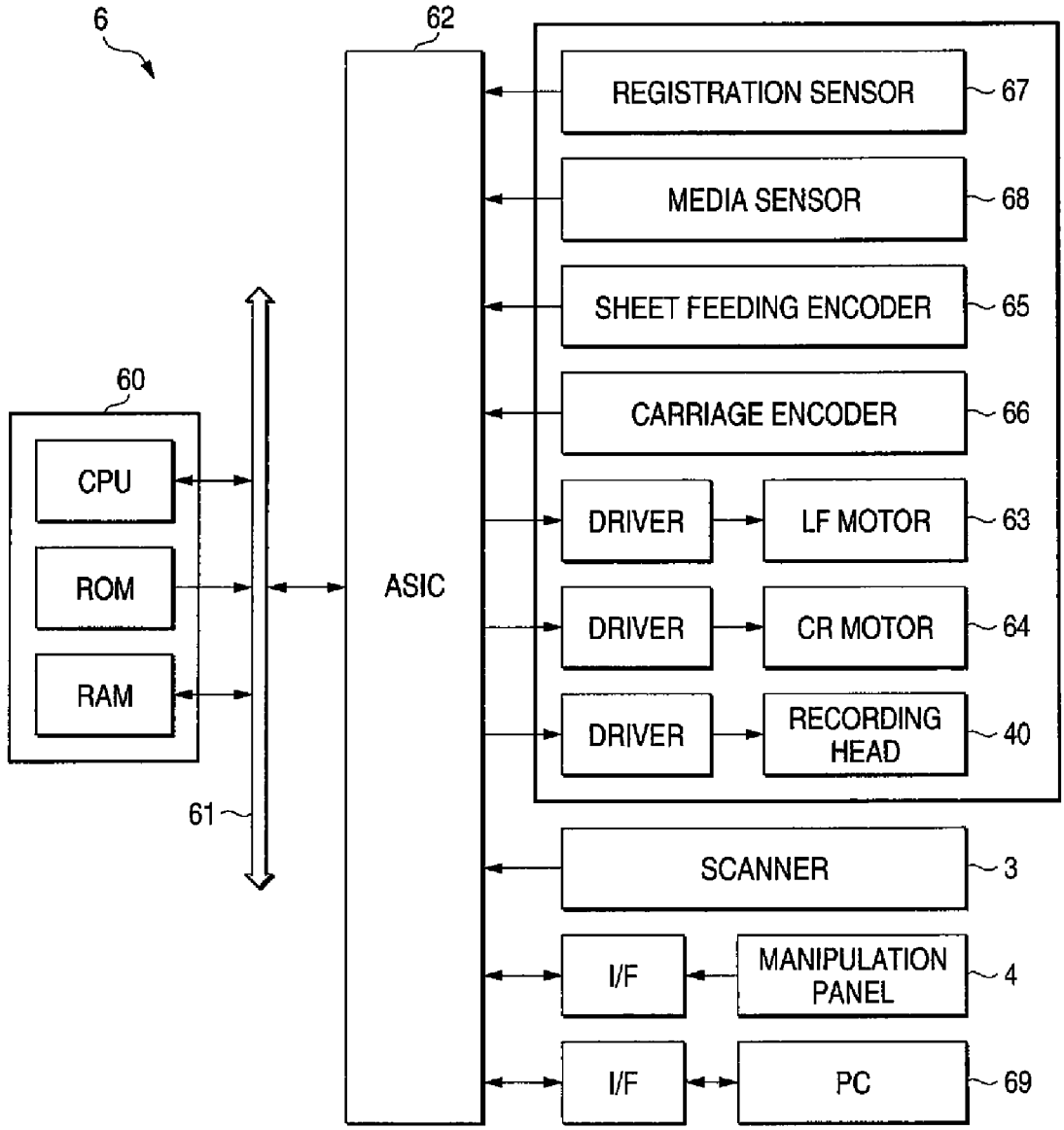
FIG. 4 is a block diagram illustrating a structure of a controller 6 of the multi function device.
Figure 5:
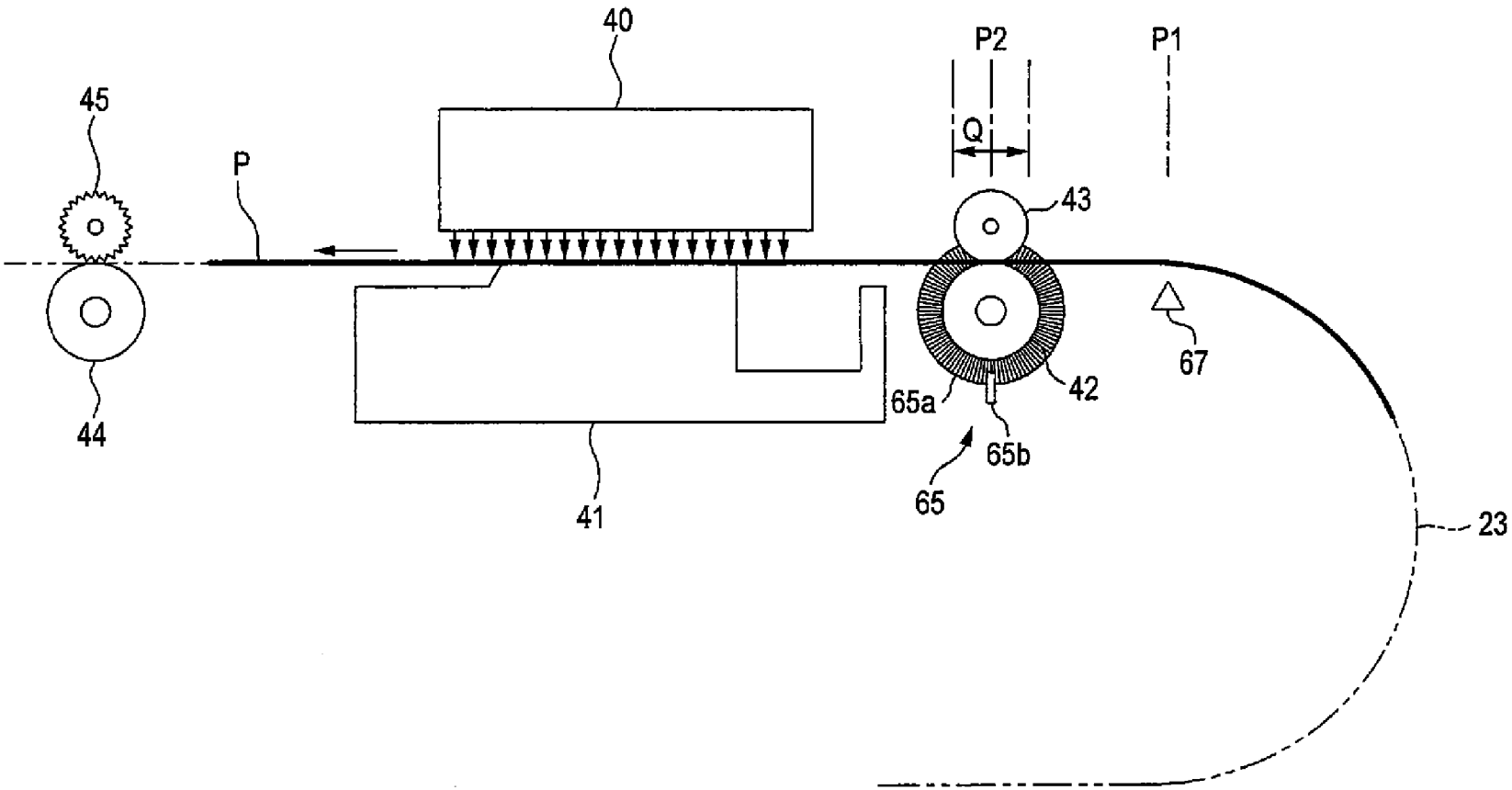
FIG. 5 is a schematic view illustrating arrangement of sensors in peripheral of a driving roller.

FIG. 4 is a block diagram illustrating a structure of a controller 6 of the multi function device 1, and FIG. 5 is a schematic view illustrating an arrangement of sensors in a peripheral of the image recording part 24.

As shown in the drawings, a central processing part 60 including a central processing unit (CPU), a read only memory (ROM), and a random access memory (RAM) is connected to various sensors, the scanner 3, and the manipulation panel 4 to transmit and receive data to and from them via a bus 61 and an application specific integrated circuit (ASIC) 62. The central processing part 60 (including a first controller and a second controller) mainly controls the rotation of an LF motor (DC motor) as a driving power source of the driving roller 42 according to information from the various sensors. In this example, the central processing part 60 wholly controls the printer 2, the scanner 3, and other components of the multi function device 1. The central processing part 60 is not necessarily a device for exclusively performing the method of the present example. As shown in the drawings, the central processing part 60 outputs control signals to a CR motor 64 for scanning the image reading carriage 32 and the inkjet recording head 40 in addition to the LF motor 63.

Moreover, the central processing part 60 can receive detecting signals from a sheet feeding encoder 65 and a carriage encoder 66 to control the rotations of the LF motor 63 and the CR motor 64. The sheet feeding encoder 65 (rotation sensor) detects the revolution of the driving roller 42 disposed at the upstream of the image recording part 24, and will be described in detail later. The carriage encoder 66 is provided to a driving pulley for driving the image reading carriage 32 to scan, and its detailed description is omitted here. Moreover, the central processing part 60 can receive detecting signals from a registration sensor (position sensor) 67 for detecting the recording sheet at a predetermined position and a media sensor 68 for detecting whether media are inserted into the slot 5. The detailed description for the registration sensor 67 will follow later. Moreover, the multi function device 1 receives the input from the manipulation panel 4 and is connected to a computer (PC) 69 to record images and documents on the recording sheets based on the image data and the document data transmitted from the computer 69. Due to this, the multi function device 1 includes an interface I/F for transmitting and receiving the data to and from the computer 69. The controller 6 described above is an example, and the controller is not limited as herein described.

FIG. 5 schematically illustrates the U-turned feeding path 23, and the arrangement of the driving roller 42 and the various sensors at the downstream of the U-turned portion of the feeding path. As shown in the drawing, a pair of the driving roller 42 and the pressing roller 43, the inkjet recording head 40, the platen 41, the sheet discharge roller 44, and the spur roller 45 are sequentially arranged along the feeding path 23 from the upstream thereof. Moreover, as shown in the drawing, at a predetermined distanced position from the driving roller 42 and the pressing roller 43 to the upstream of the feeding path 23, the registration sensor 67 is disposed. When the registration sensor 67, although not depicted in the drawing in detail, for example, is an optical sensor, an optical transmitter and an optical receiver are opposite to each other to detect whether or not the recording sheet P is between them according to whether the recording sheet P intercepts light emitted from the optical transmitter or not. As long as it functions in the same manner as the above-described sensor 67, the registration sensor 67 is not limited to the optical sensor and may utilize a commonly known sensor or any other sensors.

Moreover, in the driving roller 42, the sheet feeding encoder 65 is installed to detect the revolution of the driving roller 42. The sheet feeding encoder 65 includes an encoder wheel 65*a* in which radial-shaped marks are engraved into a transparent disc at regular pitches, and an optical sensor 65*b* for detecting the marks of the encoder wheel 65*a*. The encoder wheel 65*a*, as shown in the drawing, is fixed to the shaft of the driving roller 42 to rotate together with the driving roller 42 such that the light from the optical sensor 65*b* is intercepted by the marks of the encoder wheel 65*a*. The marks pass through the optical axis of light emitted from the optical sensor 65*b*, and rotate together with the driving roller 42, so that the revolution of the driving roller 42 can be detected by the count number of the marks of the encoder wheel 65*b*.

Hereinafter, the method, in which the central processing part 60 receives the signals from the sheet feeding encoder 65 and the registration sensor 67, and controls the inkjet recording head 40, the driving roller 42, and the sheet discharge roller 55 to feed the recording sheets P, will be described. When the leading end of the recording sheet P fed to the feeding path 23 from the sheet supply tray 20 by the sheet supply roller 25 reaches the position where the registration sensor 67 is installed, the central processing part 60 determines that the recording sheet P has reached the position P1 based on the signal from the registration sensor 67. After that, the central processing part 60 counts the number of steps of the motor for rotating the sheet supply roller 25. According to the count number, the central processing part 60 determines that the leading end of the recording sheet P has reached the position P2 where the leading end of the recording sheet P is in contact with the driving roller 42 and the pressing roller 43. Meanwhile, at that time, the driving roller 42 rotates in the reverse feeding direction. After that, the central processing part 60 rotates the driving roller 42 in the forward feeding direction after counting a predetermined count number. Due to the time lag corresponding to the count number, the leading end of the recording sheet P is brought into contact with the roller surface of the driving roller 42 and is bent so that the oblique feeding of the recording sheet P is corrected. After that, the driving roller 42 rotates so that the recording sheet P is nipped by the driving roller 42 and the pressing roller 43 and is fed onto the platen 41.

After the leading end of the recording sheet P reaches the print starting position on the platen 41, the central processing part 60 intermittently rotates the driving roller 42 by revolution amount corresponding to the unit feeding amount. Here, the "unit feeding amount" means the linefeed width when the image is continuously recorded on the recording sheet P by the inkjet recording head 40. In other words, the recording sheet P is nipped by the driving roller 42 and the pressing roller 43 and is fed below the inkjet recording head 40 every linefeed width. The central processing part 60 scans the inkjet recording head 40 in the main scanning direction with respect to the feeding every linefeed width such that inkjet recording head 40 ejects ink to record the image. In other words, the image is continuously recorded on the whole recording sheet P while repeating the recording of the image every linefeed width and feeding. Incidentally, the image recording method is not specifically limited, but may be performed, for example, in the interlace way.

The method for feeding a recording sheet P when the rear end of the recording sheet P on which the image is recorded passes through the nip position of the driving roller 42 and the pressing roller 43, that is, the position P2, will be described.

Figure 7:
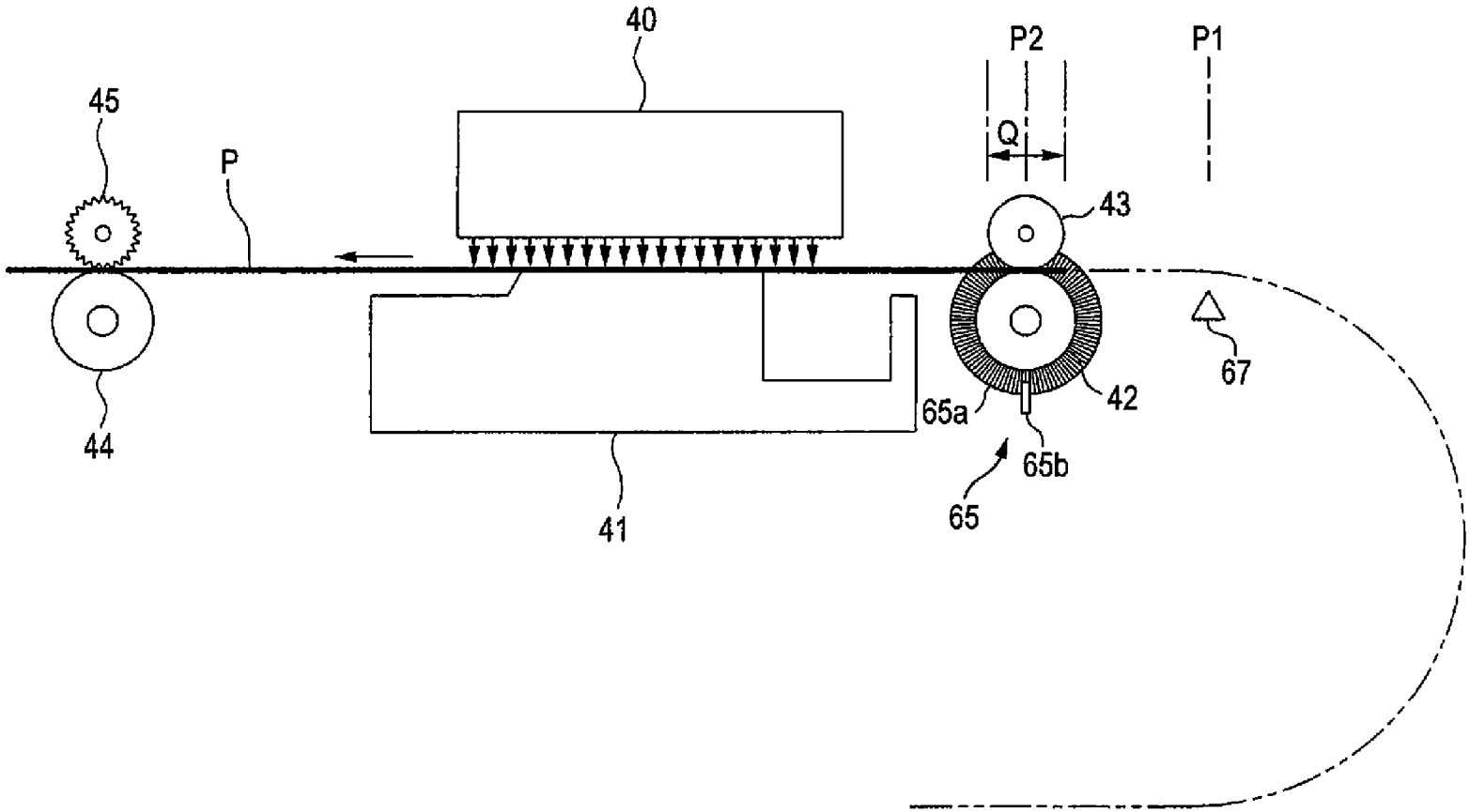
FIG. 7 is a schematic view illustrating a state of a rear end of a recording sheet entering a jumping alarm area.

The registration sensor 67 detects whether the rear end of the recording sheet P, which is fed every predetermined linefeed width, and on which the image is recorded, passes through or not. The central processing part 60 detects whether the rear end of the recording sheet P enters the jumping area or not, based on the detecting signal of the registration sensor 67. Here, the "jumping area" means an area where the possibility that the jumping phenomenon is generated in the recording sheet P is high, and specifically, an area including a position where the driving roller 42 and the pressing roller 43 nip the vicinity of the rear end of the recording sheet P, that is, a few mm area including the position P2. The central processing part 60 determines that the rear end of the recording sheet P reaches the position P1 according to the detecting signal of the registration sensor 67, counts the number of steps of the LF motor 63 for rotating the driving roller 42 after that, and determines that the rear end of the recording sheet P enters the jumping alarm area Q based on the count number. FIG. 7 is a view illustrating a state where the rear end of the recording sheet P enters the jumping alarm area Q. When the rear end of the recording sheet P enters the jumping alarm area Q, the central processing part 60 does not feed the recording sheet P every unit feeding amount (linefeed width), but every minute divisional feeding amount which is produced by dividing the unit feeding amount into plural pieces. Hereinafter, this feeding method is referred to as "minute divisional feeding." Moreover, when the jumping phenomenon of the recording sheet P is generated during the minute divisional feeding, in order to cancel the jumping amount due to the jumping phenomenon, the central processing part 60 compensates the minute divisional feeding amount.

Figure 6:
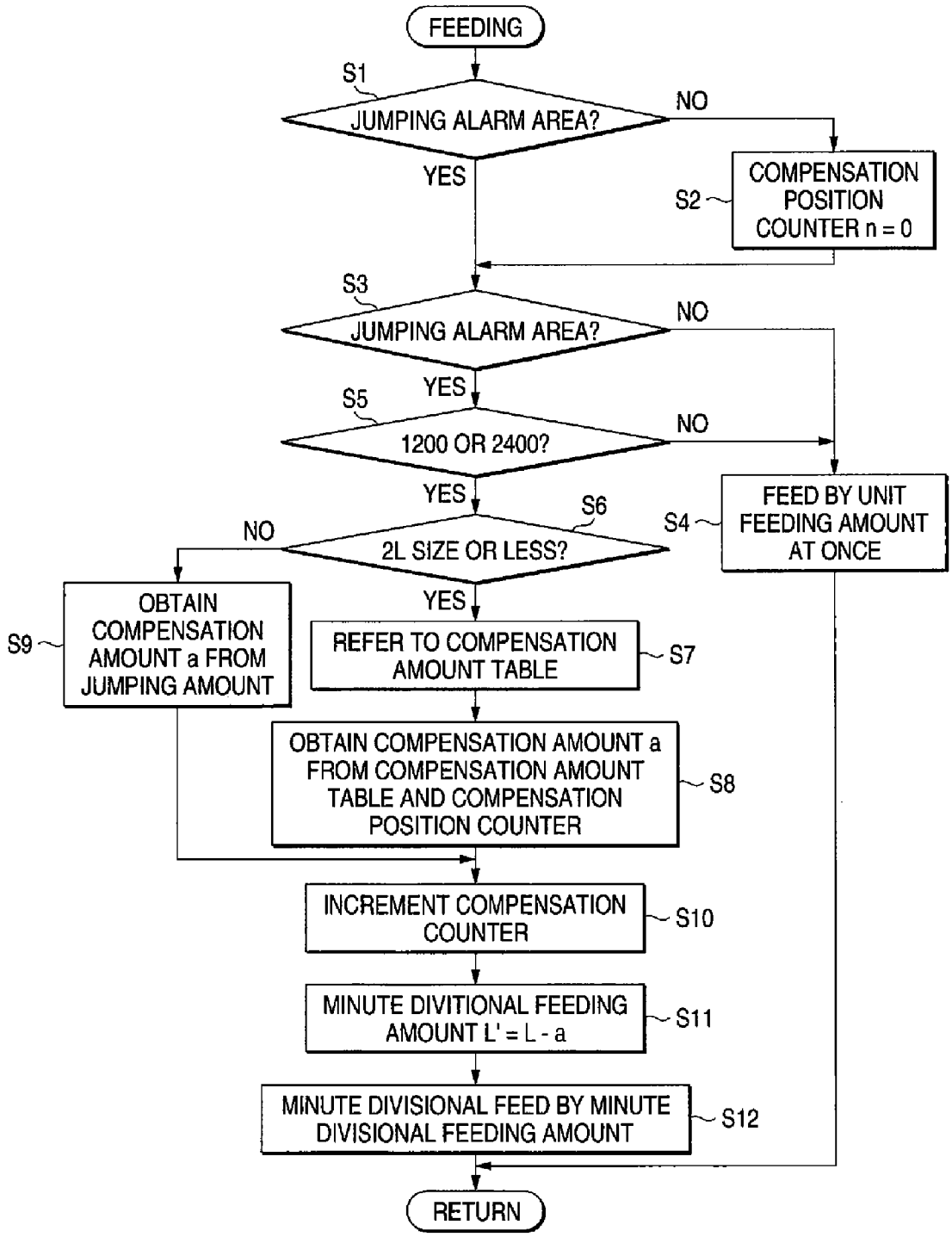
FIG. 6 is a flowchart illustrating a method for feeding a recording sheet according to an illustrative aspect of the present invention.

FIG. 6 illustrates a method for compensating the minute divisional feeding amount in the minute divisional feeding. As shown in the drawing, during the feeding of the recording sheet P, the central processing part 60 determines whether the rear end of the recording sheet P enters the jumping alarm area Q or not (S1), and sets a compensation position counter as zero when the determination at S1 is "No" (S2). The compensation position count is utilized in feeding every minute divisional feeding amount. When the rear end of the recording sheet P does not enter the jumping alarm area Q (S3), the central processing part 60 feeds the recording sheet P every unit feeding amount as described above.

Meanwhile, when the rear end of the recording sheet P enters the jumping alarm area Q (S3), the central processing part 60 determines a feeding method of the recording sheet P based on the resolution of the image recording (S5). Specifically, when the resolution of the sub-scanning direction is 1200 dpi or 2400 dpi, the recording sheet P is fed by the minute divisional feeding (S6-S12), whereas when the resolution is below the above resolution, for example, 300 dpi or 400 dpi, the recording sheet P is fed every unit feeding amount (S4). The resolution of the recording image is determined by a printer driver installed in the computer 69 when the image data transmitted from the computer 69 is to be printed and is transmitted together with the image data. The resolution can be input through the manipulation panel 4. In this manner, the feeding method is changed based on what the resolution of the sub-scanning direction is. The deterioration of the recorded image can be identified with naked eye when the jumping phenomenon is generated in the recording sheet P and the resolution is 1200 dpi or more. However, it is difficult to identify the deterioration of the recorded image and the week effect of the jumping phenomenon to the image quality when the resolution is 300 dpi or 400 dpi because the recorded image of the original sub-scanning direction is not fine. As such, when the resolution is adopted in which the deterioration of the recorded image due to jumping phenomenon of the recording sheet P is not identified, the feeding method is easily controlled and the printing speed can be also increased by feeding the recording sheet P according to the usual unit feeding amount. Meanwhile, although the method for feeding the recording sheet according to the aspect of the invention is adopted when the resolution is 1200 dpi or 2400 dpi, the resolution is not limited as herein described.

When the resolution of the sub-scanning direction is 1200 dpi or 2400 dpi, the central processing part 60 feeds the recording sheet P by the minute divisional feeding, and determines a method for compensating the jumping phenomenon of the recording sheet P according to the size of the recording sheet P (S6). Specifically, the central processing part 60 compensates using a compensation amount table (S7 and S8) when the size of the recording sheet P is 2L size (127 mm×178 mm) or less, and performs the compensation corresponding to the jumping amount when the size of the recording sheet P is larger than 2L size, for example, B5 size or A4 size (S9). A size determining device for determining the size of the recording sheet P, for example, when printing the image data transmitted from the computer 69, is implemented by the printer driver installed in the computer 69, and the size of the recording sheet P is transmitted from the computer 69 to the multi function device 1 together with the image data. Moreover, a size sensor installed in the sheet supply tray 20 or in the feeding path 23 may be utilized as the size determining device so that the size of the recording sheet P can be obtained from the output value from the size sensor. The reason why the feeding method is changed according to the size of the recording sheet P is that when the size of the recording sheet P is small, the urging force applied to the recording sheet P by the pressing roller 43 is also small so that it is difficult to precisely detect the jumping phenomenon of the recording sheet P. Thus, the selection of the feeding method according to the size of the recording sheet P is determined based on the limitation of detecting the jumping phenomenon of the recording sheet P. Meanwhile, since the urging force applied to the recording sheet P by the pressing roller 43 is varied according to the width of the recording sheet P, the determination of the compensating method according to the size of the recording sheet P as described above is not necessarily be made by the length direction size and the width direction size of the recording sheet P, and can be made only by the width of the recording sheet P. Thus, any size determining device, which detects the width of the recording sheet P, such as the above-described size sensor is acceptable.

Hereinafter, the compensating method in the case that the size of the recording sheet P is equal to or smaller than 2L size will be described.

When the size of the recording sheet P is 2L size or less, since it is difficult to precisely detect the jumping phenomenon, the central processing part 60 determines a compensation amount (S8) a with reference to a compensation amount table (S7). Since the compensation amount table, as shown in FIG. 8A or 8B, is determined according to the resolution of the sub-scanning direction and the printing having a border or not, the respective compensation amount tables T are stored in the ROM of the central processing part 60. Thus, the central processing part 60 refers to the compensation amount table T corresponding to the resolution of the sub-scanning direction or the commands of printing having a border or not, transmitted from the computer 69 or the manipulation panel 4. In the compensation amount table as shown in the drawing, 'n' indicates a compensation position and 'a' indicates a compensation amount, respectively. Here, the compensation position is a position of each minute divisional feeding amount when the unit feeding amount corresponding to the linefeed width is divided into n. Specifically, in a case of the printing having a border, for example, as shown in FIG. 8A, at the resolution of the sub-scanning direction is 1200 dpi, or 2400 dpi, the number of steps of the LF motor 63 rotated as much as the unit feeding amount is 138 steps, and each minute divisional feeding amount is 6 steps. The unit feeding amount is divided into 23 so that the compensation positions n become integers 0 to 22. In other words, the recording sheet P is not fed at one time by the unit feeding amount (138 steps) as the linefeed width, but is divisionally fed the minute divisional feeding amounts L (6 steps) over 23 times. The compensation amount table T in FIG. 8A indicates a minus compensation in which the recording sheet P is fed by any one of the 23 minute divisional feeding to cancel the amount corresponding to the jumping amount, and indicates the compensation of a compensation amount a=6 at the compensation position n=0 to 3, as shown in the drawing. Thus, at the compensation position n=0 to 3, the minute divisional feeding amount L' after the compensation is 0 (zero), and the minus compensation corresponding to 18 steps per the unit feeding amount (138 steps) is performed.

Meanwhile, although the respective minute divisional feeding amounts may not be uniform, a predetermined constant amount in which the unit feeding amount is divided into n is preferably set to the minute divisional feeding amount so that the control by the central processing part 60 becomes easy and the jumping phenomenon of the recording sheet P is safely detected. When the respective minute divisional feeding amounts are the numbers of steps for rotating the LF motor 63, although only natural numbers are adopted as the minute divisional feeding amount L, the case that there is generated a fraction when performing the final minute divisional feeding is not excluded. Moreover, although the divisional number n for dividing the unit feeding amount into n may be taken by an arbitrary value, in order to obtain the remarkable effect, preferably the divisional number is greater than 8. Meanwhile, since if the divisional number n is too large, the feeding speed decreases, the control by the central processing part 60 is complicated. Further, the accuracy of the minute divisional feeding is difficult to maintain. Thus, the divisional number is preferably up to about 20.

Meanwhile, the compensation amount table T as shown in FIG. 8B is for the case that the resolution of the sub-scanning direction is 2400 dpi and there is no border. In this case, the number of steps of the LF motor 63 rotated by the unit feeding amount is 69 steps, and each minute divisional feeding amount L is 6 steps. Thus, the unit feeding amount is divided into 12 so that the compensation position n becomes integers of 0 to 11. Meanwhile, in this case, the minute divisional feeding amount at the compensation position n=11 becomes 3 steps of the fraction. In this case, as shown in the drawing, the compensation for the compensation amount a=6 at the compensation positions n=0, 2, 4 is depicted. Thus, at the compensation positions n=0, 2, 4, the minute divisional feeding amount L' after the compensation is zero, and the minus compensation corresponding to the 18 steps per the unit feeding amount (69 steps) is performed. The compensation amount table T is stored in the ROM of the central processing part 60 so that the central processing part 60 obtains the compensation amount a based on the corresponding compensation amount table T and the count number of the compensation position counter. Meanwhile, how much is the minus compensation performed at which position n is determined such that the data are obtained by actually using an apparatus in advance and the recording image is getting the best. In this aspect of the present invention, the compensation amount table T is separately determined according to the resolution of the sub-scanning direction and whether the printing has a border or not. However, the compensation amount table is not limited as herein described.

In this manner, the central processing part 60 obtains the compensation amount a from the compensation amount table T and the number of the compensation position counters as shown in FIGS. 8A and 8B. For example, when the resolution of the sub-scanning direction is 2400 dpi, the printing has no border, and the number of the compensation position counter is zero, the compensation amount is a=6. Next, the central processing part 60 increments the number of the compensation amount counter only by one to set n=1 (S10), thereby determining the minute divisional feeding amount L' after the compensation (S11). The minute divisional feeding amount L' after the compensation is the minute divisional feeding amount L in which the unit feeding amount is divided into n, and in this case, is an amount L'=L−a that the compensation amount a is subtracted from the 6 steps. After that, the LF motor 63 as the driving power source of the driving roller 42 is commanded to drive the 0 step corresponding to the minute divisional feeding amount L' after the compensation. Here, since the minute divisional feeding amount after the compensation at the compensation position n=0 is L'=0, the LF motor 63 is not driven so that the driving roller 42 does not rotate and the feeding amount of the recording sheet P at the compensation position n=0 is also 0 (S12). Similarly, the central processing part 60 obtains the compensation amount a=0 from the compensation amount table as shown in FIG. 8B, with respect to the compensation position n=1, determines the minute divisional feeding amount after the compensation L'=6, and commands the LF motor 63 to drive the 6 steps corresponding to the minute divisional feeding amount L'. By doing so, the driving roller 42 rotates as much as the 6 steps, and the feeding amount of the recording sheet P at the compensation position n=1 becomes the minute divisional feeding amount corresponding to the 6 steps.

After repeating the n-division of the unit feeding amount to feed the recording sheet P by the minute divisional feeding amount, the inkjet recording head 40 scans in the main scanning direction to eject ink and record the image. At that time, due to the minute divisional feeding, the minus compensation of the 18 steps per the unit feeding amount is performed. Since this compensation amount is determined while estimating the jumping amount generated in the recording sheet P equal to or smaller than the 2L size in advance, the corresponding compensation amount is roughly the same as the actual jumping amount of the recording sheet P and the jumping amount is canceled. Thus, when the image is recorded on the recording sheet P on a unit band basis, where the unit band is a piece divided in the sub-scanning direction, the specks generated in the respective connected portions between the bands, the so-called banding at the vicinity of the rear end of the recording sheet P, can be prevented.

Figure 9:
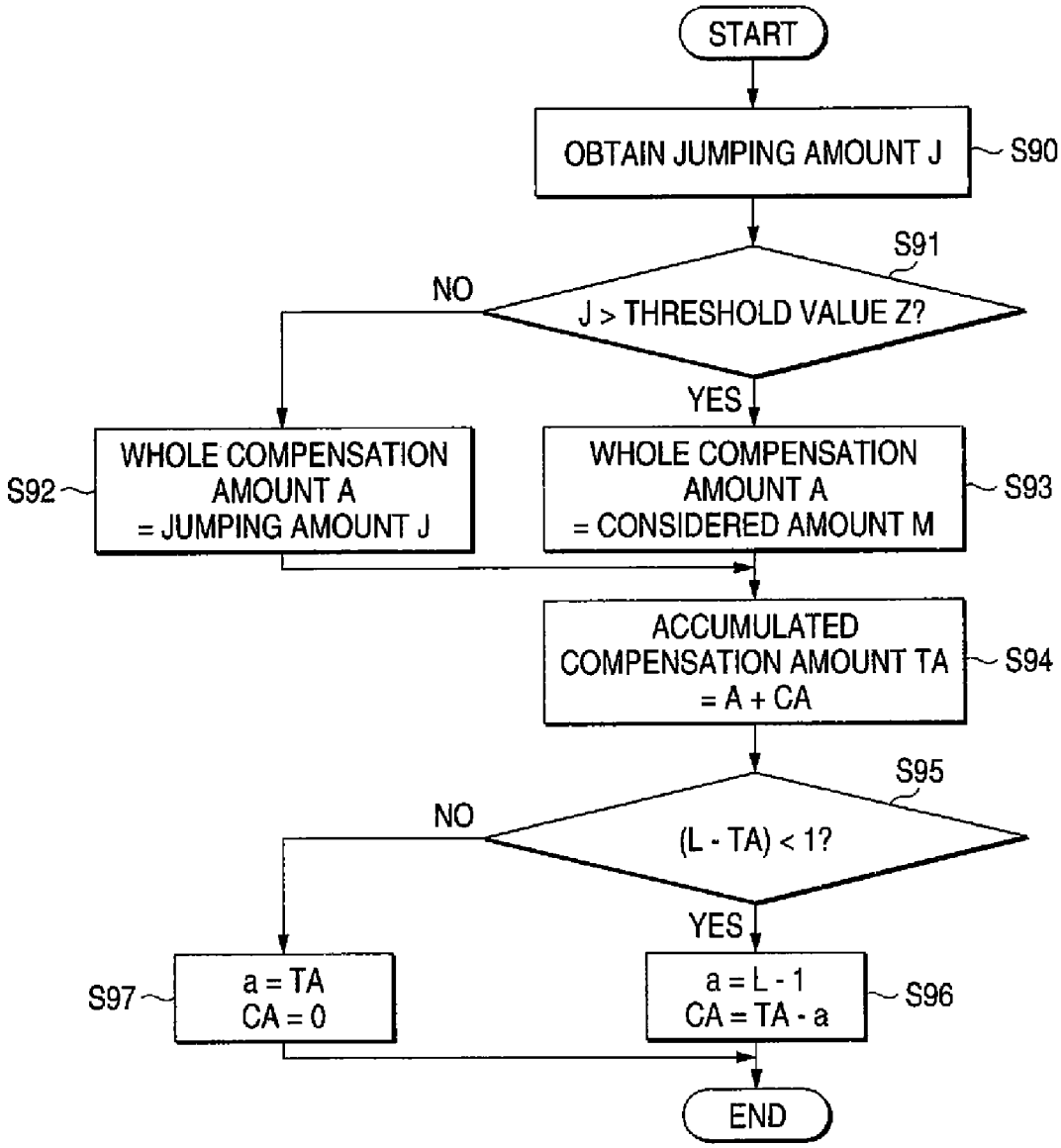
FIG. 9 is a flowchart illustrating a method for obtaining a compensation amount a when a recording sheet is larger than a 2L size.
Figure 11:
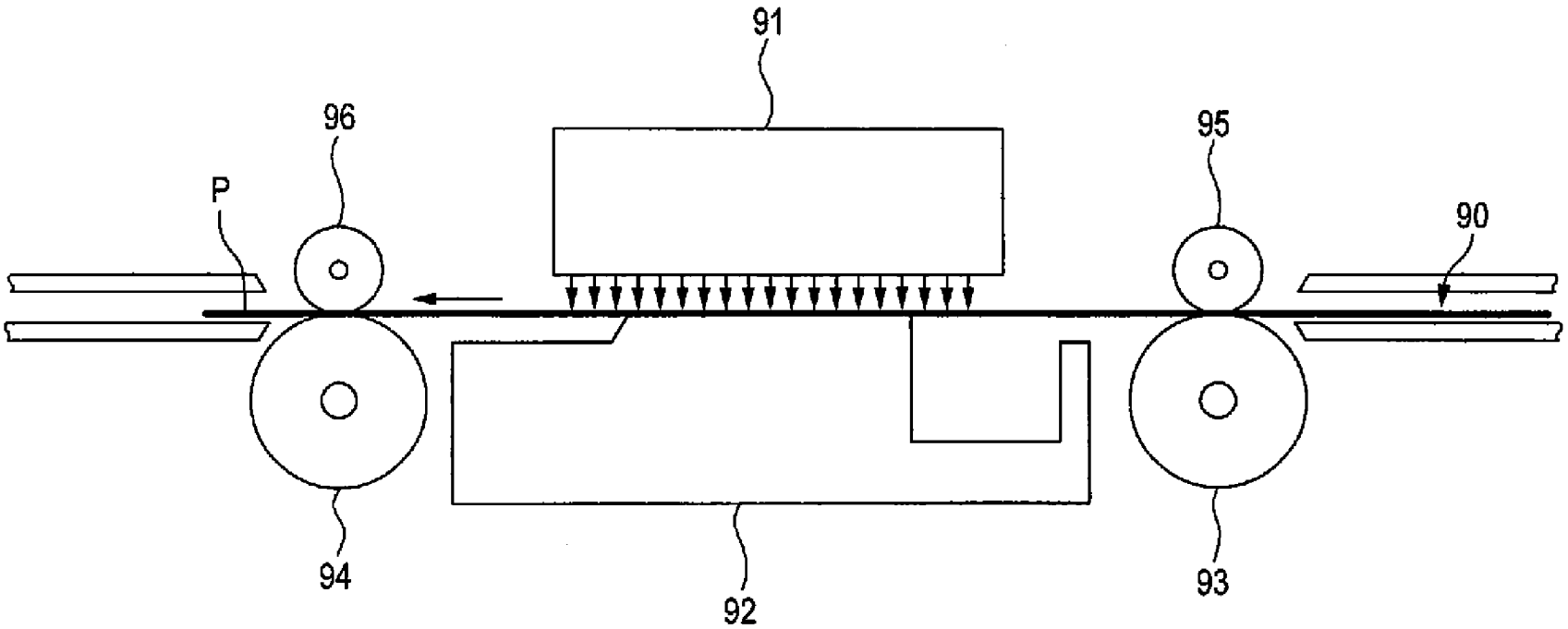
FIG. 11 is a view illustrating a peripheral structure of an image recording part of a conventional image recording apparatus.
Figure 12:
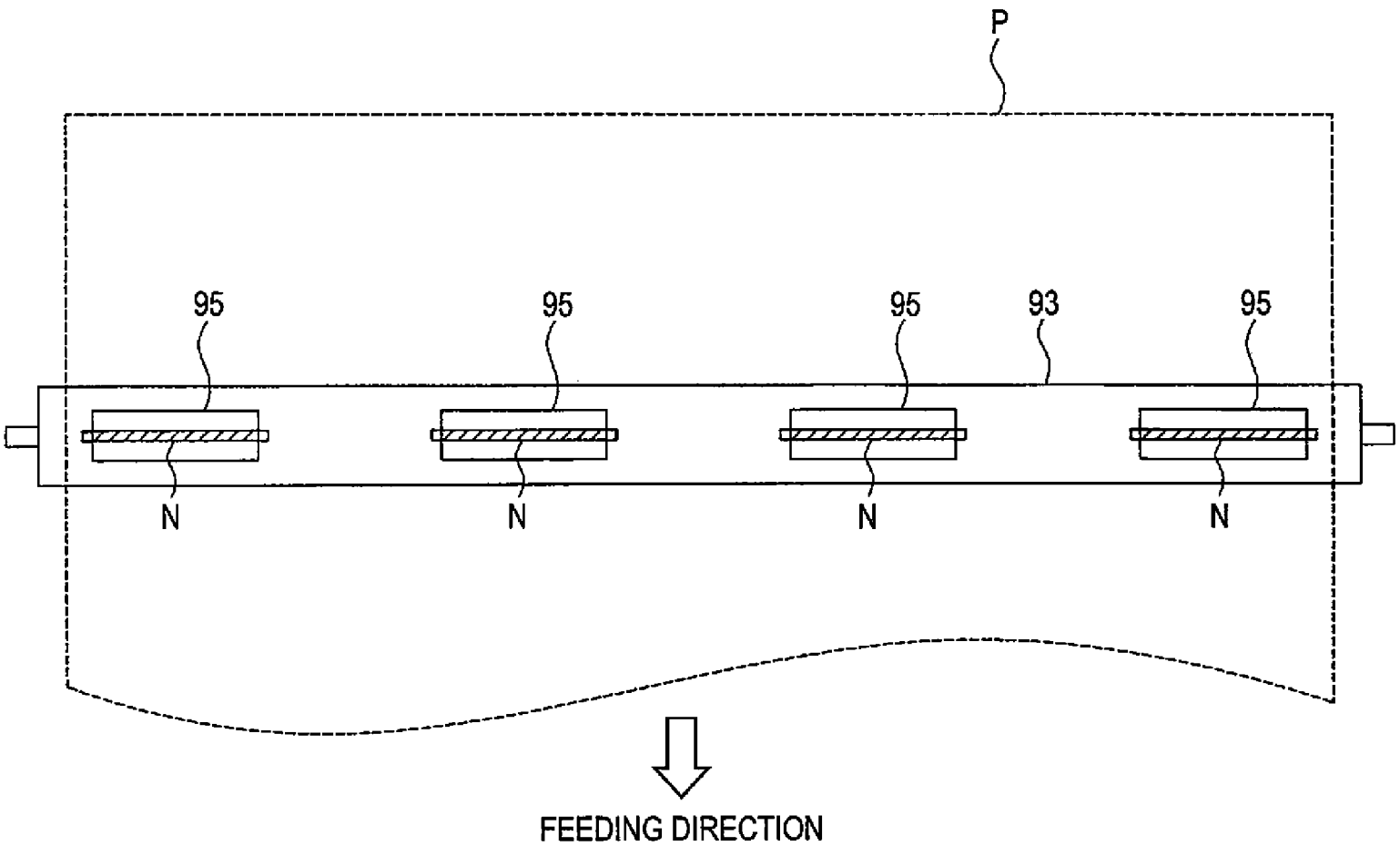
FIG. 12 is a plan view illustrating a driving roller and a pressing roller of the conventional image recording apparatus.

Hereinafter, the compensating method (adjusting method) in a case that the size of the recording sheet P is greater than the 2L size will be described with reference to FIG. 9.

When the size of the recording sheet P is greater than the 2L size, since the driving roller 42 rotates due to the jumping phenomenon of the recording sheet P, the rotation of the driving roller 42 is detected by the sheet feeding encoder 65 so that the jumping phenomenon and the jumping amount are obtained. As described above, since the driving roller 42 is pressed by and in contact with the pressing roller 43 such that the recording sheet P is nipped and fed by the driving roller 42 and the pressing roller 43, and the recording sheet P comes into close contact with the driving roller 42 during the feeding, the driving roller 42 rotates corresponding to the jumping amount when the jumping phenomenon of the recording sheet P is generated. Moreover, since the pressing roller 43 is disposed at the upstream of the feeding path 23, i.e., the upstream of the image recording part 24, in other words, the driving roller 42 presses the recording sheet P before recording the image, the recorded image is not affected by the high pressure that brings the driving roller 42 into close contact with the recording sheet P. Thus, by detecting the rotation of the drive roller 42 by the sheet feeding encoder 65, the jumping phenomenon of the recording sheet P and the jumping amount can be accurately obtained.

As described above, when the resolution of the sub-scanning direction is 2400 dpi and the printing has no border, the step number of the LF motor 63 rotated by the unit feeding amount is 60 steps, each the minute divisional feeding amount L is divided into 12 with the 6 steps and 3 steps of the fraction. Here, the compensating method corresponding to the jumping amount at the kth position where the jumping is generated in the recording sheet P, that is, the compensation position n=5, will be described. The rear end of the recording sheet P enters the jumping alarm area Q, and the recording sheet P is fed by the minute divisional feeding amount L at the compensation positions n=1 to 4. FIG. 10 is assuming that at the compensation positions n=5, the jumping amount of 9 steps is generated. In other words, the jumping amount of the 9 step in addition to the minute divisional feeding amount L=6 is generated at the compensation position n=5, and the recording sheet P is moved as much as 15 steps. Since the LF motor 63 as the power source of the driving roller 42 receives the revolution of the 6 steps as the minute divisional feeding amount from the central processing part 60, whether the driving roller 42 rotates by the revolution corresponding to the 6 steps or not can be determined by the detected value of the sheet feeding encoder 65. Thus, the detected value of the sheet feeding encoder 65, that is, a target value at the compensation position n=5, in other words, the value shifted from the detected value corresponding to the 6 steps is determined as the excessive revolution of the driving roller 42. By doing so, the central processing part 60 obtains the jumping amount (S90). Next, the central processing part 60 determines whether the jumping amount J is greater than a predetermined threshold value Z or not (S91). When the jumping amount J is the threshold value Z or less, the jumping amount J is set as a whole compensation amount A (S92). When the jumping amount J is greater than the threshold value Z, a determined value M substituting the jumping amount J is set as the whole compensation amount A (S93). The threshold value Z is set so that the jumping amount of the recording sheet P is rapidly cancelled within a practical range. If the compensation is performed even in an extreme case where the jumping amount excessively exceeds a usually assumed jumping amount, the control of the driving roller becomes complicated. Thus, the compensation is performed to correspond to just the upper limit of the usually assumed jumping amount. For example, when the jumping amount J of 50 steps is generated at the compensation position n=5, the minute divisional feeding of 30 steps (as much as the compensation positions n=1 to 5) has already been performed, so the minus compensation can not be performed out of the range of the rest 39 steps and it is impossible to wholly cancel the jumping amount of 50 steps. Moreover, according to the compensation position where the jumping amount is generated, although it is possible to cancel the excessive jumping amount with the rest of the minute divisional feeding, there is a need to perform the minus compensation with the majority of the respective minute divisional feeding after that, and the control of the driving roller 42 by the central processing part 60 is complicated. In consideration of these facts, with respect to the excessive jumping amount J, the minus compensation can be performed such that the predetermined amount M is set to the whole compensation amount A within a degree that the control by the central processing part 60 is not excessively burdened. The threshold value Z and the determined amount M are set in consideration of the processing capacity of the central processing part 60 or the minute divisional feeding amount. For example, in the case where the minus compensation for canceling the jumping amount J is performed not more than successive three minute divisional feedings, and the minute divisional feeding amount L' after the compensation is set to be one step or more, the threshold value Z can be set to 16 steps and the determined value M can be set to 15 steps. Thus, in the example described above, since the jumping amount J=9 steps, the jumping amount J becomes the whole compensation amount A. Meanwhile, when the jumping amount J greater than the determined value M is generated, it can be considered that the jumping amount J cannot be cancelled. In order to compensate the excessive jumping amount J, since the driving roller 42 must be reversely rotated to feed the recording sheet P backward, the control becomes complicated. Moreover, the possibility of generating such an excessively large jumping amount J is not high. Therefore, in the present example, the compensation is not performed to cancel the jumping amount J in which there is a need to reversely rotate the driving roller 42, and the minute divisional feeding amount is adjusted to cancel the jumping amount J having a high possibility of occurrence so that the compensation of the jumping amount J is achieved by a practical and simple control.

Next, the central processing part 60 obtains an accumulated compensation amount TA (S94). The accumulated compensation amount TA is the whole compensation amount A added by a delayed compensation amount CA. The minus compensation enabled by a single time minute divisional feeding cannot be obtained within the minute divisional feeding amount L, for example, assuming the maximum compensation amount enabled by the single time minute divisional feeding amount is 5 steps, the minus compensation is performed by the plurality of minute divisional feedings when the jumping amount J greater than 6 steps is generated. In this case, the compensation amount of subtracting the compensation amount a of the present time from a compensation amount for delaying the minute divisional feeding of the next time, that is, the whole compensation amount TA, is the delayed compensation amount CA (CA=TA−a). In this example, since the jumping phenomenon does not occur at the compensation positions n=1 to 4, the delayed compensation amount CA at the present time is CA=0 step. Thus, the accumulated compensation amount TA becomes the whole compensation amount A (TA=A+CA).

Next, the central processing part 60 determines whether the amount of subtracting the accumulated compensation amount TA from the minute divisional feeding amount L is greater than 1 (one) step or not (S95). In other words, when the jumping amount J of the recording sheet P due to the kth minute divisional feeding is detected, the maximum compensation amount a due to the (K+1)th minute divisional feeding is an amount of subtracting 1 (one) step from the minute divisional feeding amount L. Thus, in the present minute divisional feeding, the minute divisional feeding more than 1 (one) step is performed at all the compensation positions n. When an amount of subtracting the accumulated compensation amount TA from the minute divisional feeding amount L is smaller than 1 (one) step, the compensation amount a is minute divisional feeding amount L−1 step=5 steps (S96). Moreover, the delayed compensation amount CA is an amount of subtracting the compensation amount a from the accumulated compensation amount TA (CA=TA−a). Meanwhile, when an amount of subtracting the accumulated compensation amount TA from the minute divisional feeding amount L is equal to or greater than 1 (one) step, the compensation amount a is the accumulated compensation amount TA (A=TA), and the delayed compensation amount CA is 0 (zero) (S97). In the preferred example, since the accumulated compensation amount TA is 9 steps (TA=9 steps), the compensation amount a of the 6th minute divisional feeding is 5 steps (a=5 steps) and the delayed compensation amount CA is 4 steps (CA =4 steps) Since the compensation amount a obtained by doing so is 5 steps (a=5 steps), the central processing part 60 obtains the minute divisional feeding amount L' of the 6th minute divisional=1 (one) step (S11) and commands the LF motor 63 to minute divide the corresponding minute divisional feeding amount L'. Continuously, in the 7th minute divisional feeding, the central processing part 60 obtains the compensation amount a=4 steps, and commands the LF motor 63 to minutely divide the minute divisional feeding amount L'=2 steps. After that, when the jumping phenomenon is generated in the recording sheet P, the compensation amount a is 0 (zero) (a=0), and as shown in FIG. 9, like a predetermined minute divisional feeding amount L, the minute divisional feeding of 6 steps at the compensation positions n=8 to 11, and of 3 steps at the compensation position n=12. As a result, all the minute divisional feeding amount performed by the central processing part 60 is 60 steps, and decreases as much as the jumping amount J=9 steps. In other words, the jumping amount J=9 steps is cancelled by the minus compensation. By doing so, the unit feeding amount is maintained uniform, even when the inkjet recording head 40 scans in the main scanning direction to eject ink and to record the image after the all minute divisional feedings corresponding to the unit feeding amount are performed. Thus, the deterioration of the image in the vicinity of the rear end of the recording sheet P due to the jumping phenomenon can be prevented.

Meanwhile, in this example, the compensation of canceling the jumping amount J by the (k+1)th minute divisional feeding is performed when the jumping amount J of the recording sheet P due to the kth minute divisional feeding is detected, and the compensation is further performed by the minute divisional feedings of the (k+2)th and thereafter minute divisional feedings when the jumping amount J not is cancelled by the (k+1)th compensation, so that the canceling of the jumping amount can be performed as soon as possible immediately after the jumping phenomenon occurs. Therefore, for example, although the kth minute divisional feeding is in the vicinity of the nth minute divisional feeding amount of the unit feeding amount divided into n, the kth minute divisional feeding where the jumping phenomenon is generated in the recording sheet P cancels the jumping amount J and can maintain the unit feeding amount uniform until the minute divisional feeding as much as the unit feeding amount is finished. Moreover, the corresponding jumping amount J can be canceled not only when immediately after the kth minute divisional feeding is conducted where the jumping amount J is detected but also by the (k+1)th to (k+3)th minute divisional feedings, and the same effect can be achieved.

As described above, according to the method for feeding a recording sheet P of the aspect of the invention, the minute divisional feeding of the recording sheet P is performed every minute divisional feeding amount in which the unit feeding amount is divided into n when the rear end of the recording sheet P, which is fed every unit feeding amount by the driving roller 42 and the pressing roller 43, and on which an image is recorded, enters the jumping alarm area Q, and the minute divisional feeding amount L is adjusted by the compensation amount a to cancel the corresponding jumping amount J when the sheet feeding encoder 65 detects the jumping phenomenon and the jumping amount of the recording sheet P according to the excessive revolution of the driving roller 42 during the corresponding minute divisional feeding, so that the compensation for jumping amount J is easily and securely performed.

Especially, like the printer 2 of the multi function device 1, in a case that the portion of the feeding path 23 upstream of the driving roller 42 and the pressing roller 43 is U-turned from the location below the nipping area of the driving roller 42 and the pressing roller 43 for guiding the recording sheet P to U-turn, and the recording sheet P is fed to ascend by the driving roller 42 and the pressing roller 43, there is no need to increase the nipping force of the driving roller 42 and the pressing roller 42 to nip the recording sheet P. In this case, the pressure when the nipping is released is sufficiently strong and the jumping phenomenon is not easily generated in the recording sheet P. Thus, applying the above-described method is remarkably effective.

In addition, in this example, the compensating method for the jumping phenomenon of the recording sheet P is determined based on the size of the recording sheet P (S6), such that if the size of the recording sheet P is the 2L size or less, the compensation using the compensation amount table (S7 and S8) is conducted, if greater than the 2L size, the compensation corresponding to the jumping amount is performed (S9). However, it is not necessary to select only one of the compensation using the compensation amount table (S7 and S8) and the compensation corresponding to the jumping amount (S9). In other words, if the size of the recording sheet P is the 2L size or less, the compensation corresponding to the jumping amount (S9) is performed after performing the compensation using the compensation amount table (S7 and S8), or, the compensation using the compensation amount table (S7 and S8) is performed after performing the compensation corresponding to the jumping amount (S9). It is also valuable to control to perform the minute divisional feeding of the minute divisional feeding amount L' after the compensations. According to the control of the above-described feeding method, if the size of the recording sheet P is smaller than a predetermined size, in a case of the compensation corresponding to the jumping amount (S9), the jumping amount J is not easily detected, so that the minute divisional feeding amount L is substantially compensated by the compensation using the compensation amount table (S7 and S8). In the case when a large jumping amount J is generated even when the size of the recording sheet P is smaller than the predetermined size, the excessive revolution of the driving roller 42 is detected by the sheet feeding encoder 65 so that the compensation corresponding to the jumping amount is performed.

What is claimed is:

1. A method for feeding a recoding medium for use in an image recording apparatus including a sheet-feeding path, a feeding device disposed at an upstream side of the sheet-feeding path and having a rotation sensor, a pair of rollers for nipping the recording medium and a recording device disposed at a downstream side of the sheet-feeding path to record an image on the recording medium to be fed, the method comprising the steps of:

feeding the recording medium along the sheet-feeding path by a unit feeding amount;

detecting an entrance of a rear end of the recording medium into a jumping alarm area;

dividing the unit feeding amount into minute divisional feeding amounts such that the recording medium is fed by each minute divisional feeding amount when the rear end of the recording medium enters the jumping alarm area;

detecting a jumping amount of the recording medium according to the rotation sensor when a jumping phenomenon occurs in the recording medium; and adjusting the minute divisional feeding amount to cancel the jumping amount.

2. The method for feeding a recoding medium according to claim 1, wherein the occurrence of the jumping phenomenon is determined when the rotation sensor detects an excessive rotation of the roller.

3. The method for feeding a recoding medium according to claim 1, wherein the pair of rollers includes a driving roller equipped with the rotation sensor, and a pressing roller driven by the driving roller while being pressed against the driving roller with a predetermined pressure.

4. The method for feeding a recoding medium according to claim 1, wherein the minute divisional feeding amount is determined by dividing the unit feeding amount into n.

5. The method for feeding a recording medium according to claim 4, wherein n is 8 or more and is 20 or less.

6. The method for feeding a recoding medium according to claim 1, wherein when the jumping amount of the recording medium is detected by a kth minute divisional feeding of the recording medium, a maximum compensation of the feeding amount of the recording medium is performed by a (k+1)th minute divisional feeding, and when the jumping is not cancelled by the compensation, the feeding amount is additionally compensated by a (k+2)th minute divisional feeding of the recording medium.

7. The method for feeding a recoding medium according to claim 1, wherein when the jumping amount of the recording medium is detected by a kth minute divisional feeding of the recording medium, the jumping amount is cancelled by a (k+1)th minute divisional feeding and/or a (k+3) th minute divisional feeding of the recording medium.

8. The method for feeding a recoding medium according to claim 1, wherein when the detected jumping amount exceeds a predetermined threshold value, the minute divisional feeding amount of the recording medium is adjusted by a predetermined amount.

9. The method for feeding a recoding medium according to claim 1, wherein when the recording medium is equal to or smaller than a predetermined size, a sixth step of adjusting the minute divisional feeding amount by a predetermined compensation amount is further performed.

10. A method for feeding a recoding medium for use in an image recording apparatus including a sheet-feeding path, a feeding device disposed at an upstream side of the sheet-feeding path and having a rotation sensor, a pair of rollers for nipping the recording medium and a recording device disposed at a downstream side of the sheet-feeding path to record an image on the recording medium to be fed, the method comprising the steps of:

feeding the recording medium along the sheet-feeding path by a unit feeding amount;

detecting an entrance of a rear end of the recording medium into a jumping alarm area;

dividing the unit feeding amount into minute divisional feeding amounts such that the recording medium is fed by each minute divisional feeding amount when the rear end of the recording medium enters the jumping alarm area; and adjusting the minute divisional feeding amount by a predetermined compensation amount when the recording medium is equal to or smaller than a predetermined size.

11. A method for feeding a recoding medium for use in an image recording apparatus including a sheet-feeding path, a feeding device disposed at an upstream side of the sheet-feeding path and having a rotation sensor, a pair of rollers for nipping the recording medium, a recording device disposed at a downstream side of the sheet-feeding path to record an image on the recording medium to be fed and a size determining device for determining a size of the recording medium, the method comprising the steps of:

feeding the recording medium along the sheet-feeding path by a unit feeding amount;

detecting an entrance of a rear end of the recording medium into a jumping alarm area;

dividing the unit feeding amount into minute divisional feeding amounts such that the recording medium is fed by each minute divisional feeding amount when the rear end of the recording medium enters the jumping alarm area; and adjusting the minute divisional feeding amount by a predetermined compensation amount when the recording medium is equal to or smaller than a predetermined size.

12. The method for feeding a recoding medium according to claim 11, wherein the minute divisional feeding amount is determined by dividing the unit feeding amount into n.

13. The method for feeding a recording medium according to claim 12, wherein n is 8 or more and is 20 or less.

14. An image recording apparatus for recording an image on a recording medium, comprising:

a sheet-feeding path;

a feeding device including a pair of rollers disposed at an upstream side of the sheet-feeding path to nip the recording medium and to feed the recording medium along the sheet-feeding path by a unit feeding amount;

a recording device disposed at a downstream side of the sheet-feeding path to record the image on the recording medium;

a position sensor that detects a position of a rear end of the recording medium being fed;

a rotation sensor that detects a rotation of the roller; and a controller that controls the rotation of the roller, the controller including a first controlling part for controlling the rotation of the roller such that the unit feeding amount is divided into a plurality of minute divisional feeding amounts and the recoding medium is fed by a corresponding minute divisional feeding amount when the end of the recording medium enters a jumping alarm area, and a second controlling part for controlling the rotation of the roller such that, when a jumping phenomenon occurs in the recording medium, a jumping amount of the recording medium is estimated based on the revolution of the rotation sensor to cancel the jumping amount.

15. The image recording apparatus according to claim 14, wherein the rotation sensor comprises an encoder for detecting an excessive rotation of the roller generated by the jumping phenomenon.

* * * * *